US006764076B2

(12) United States Patent
Merritt

(10) Patent No.: US 6,764,076 B2
(45) Date of Patent: Jul. 20, 2004

(54) AUTOMOBILE RACING BOARD GAME

(76) Inventor: Gary Merritt, 92 Lakeshore Rd., Mt. Juliet, TN (US) 37122

( * ) Notice: Subject to any disclaimer, the term of this patent is extended or adjusted under 35 U.S.C. 154(b) by 0 days.

(21) Appl. No.: 10/085,870

(22) Filed: Feb. 28, 2002

(65) Prior Publication Data

US 2003/0160388 A1 Aug. 28, 2003

(51) Int. Cl.[7] ..... A63F 3/00
(52) U.S. Cl. ..... 273/246; 273/259; 273/277
(58) Field of Search ..... 273/236, 242, 273/246, 244, 259, 277; D21/359, 350, 362, 365, 367; 434/128, 129

(56) References Cited

U.S. PATENT DOCUMENTS 5,114,152 A * 5/1992 Rouse et al. ..... 273/246
6,095,522 A * 8/2000 Spell et al. ..... 273/246
6,464,223 B2 * 10/2002 Rutter ..... 273/246

* cited by examiner

*Primary Examiner*—Vishu K Mendiratta
(74) *Attorney, Agent, or Firm*—Dickstein, Shapiro, Morin & Oshinsky, LLP.

(57) ABSTRACT

A new and improved automobile racing board game that captures the real-life rules and strategies involved in a Nascar® sanctioned Stock Car race, such as aerodynamic drafting between the cars and taking optimal grooves around the race track, and accurately represents them in Board Game form. The invention described herein includes a game board and game pieces, said game board having a plurality of linear and circuitous movement paths disposed concentrically thereon representing a racetrack, at least one die provided for determining movement along the plurality of movement paths, which also affect movement of the player's piece on said movement paths. The game pieces are shaped like miniature racecars and are meant to represent actual Nascar® racecars.

5 Claims, 4 Drawing Sheets

FAST TRACKS
THE BOARD GAME

DRAW CARD

TIME FOR TIRE CHANGE
(PIT WHEN YOU GET TO PIT ROW)

LOOSE TURN
ROLL FOR DICE

CAR LOOSE

GO TO PITS
ROLL OUT WITH 4 DICE
(WHEN YOU GET TO PIT ROW)

TIME FOR TIRE CHANGE
(PIT WHEN YOU GET TO PIT ROW)

LOOSE TURN
ROLL FOR DICE

CAR LOOSE

GO TO PITS
ROLL OUT WITH 4 DICE
(WHEN YOU GET TO PIT ROW)

CAR RUNNING LOW

FUEL PIT WHEN YOU GET TO
PIT ROW.
LOSE TURN ROLL 4 DICE

*FIG. 4*

AUTOMOBILE RACING BOARD GAME

FIELD OF THE INVENTION

The present invention relates to board games and more particularly pertains to a new board game for automobile racing enthusiasts, challenging players to win a simulated race in a novel board game while moving their playing piece from the start area to the finish area.

DESCRIPTION OF THE PRIOR ART

Board games in general are well-known in the prior art, and have been for many years a favorite pastime at family or social gatherings. More specifically, board games previously devised and utilized are known to consist of familiar, expected and obvious structural configurations, not withstanding the myriad of designs encompassed by the crowded prior art, which have been developed for the fulfillment of countless objectives and requirements.

Known prior art board games include U.S. Pat. Nos. 5,758,876; 6,209,871 B1; 5,139,266; and 4,241,924.

While these prior art board games fulfill their respective, particular objectives and requirements, the aforementioned patents do not disclose a novel Board Game dedicated to automobile racing enthusiasts in general, and Nascar® Stock Car Racing fans in particular. The invention described herein captures the real-life rules and strategies involved in a Nascar® sanctioned Stock Car race, such as aerodynamic drafting between the cars and taking optimal grooves around the race track, and accurately represents them in Board Game form. The invention described herein includes a game board and game pieces, said game board having a plurality of linear and circuitous movement paths disposed concentrically thereon representing a racetrack, at least one die provided for determining movement along the plurality of movement paths, which also affect movement of the player's piece on said movement paths. The game pieces are shaped like miniature racecars and are meant to represent actual Nascar® racecars. The players begin the race by first determining which player is on "Pole Position", or first starting position, then the second and so on. There are a plurality of possible paths, or "lanes" around the racetrack that the players' pieces can move on. The winner of the game is the player who first reaches the checkered flag after completing a pre-determined number of laps around the racetrack.

In these respects the Board Game according to the present invention substantially departs from the conventional concepts and designs of the prior art, and in so doing provides a challenging new game for race fans of all ages, while simultaneously providing for younger players a learning apparatus for the rules and strategies of automobile racing that is both fun and educational.

SUMMARY OF THE INVENTION

The present invention provides a new Board Game construction wherein it can be utilized for challenging players to be the first to move their playing piece from their respective starting position to the finishing line or "checked flag," while overtaking other players and avoiding "crashing" out of the race.

The general purpose of the present invention, which will be described subsequently in greater detail, is to provide a new Board Game apparatus and many novel features that result in a new Board Game which is not anticipated, rendered obvious, suggested, or even implied by any of the prior art board games, either alone or in any combination thereof.

To attain this the present invention generally comprises a game board, said game board having a plurality of linear and circuitous movement paths disposed thereon, at least one die provided for determining players' starting positions and movement along the plurality of movement paths. Players determine their starting position on the "starting grid" by a roll of the dice. As in a real life race, players that start from behind the pole position can also win the race if the player utilizes the proper racing strategies. There are particular spaces along the movement path that allows for lane changes to overtake other players, but there are also spaces that would lead to crashes if the player's piece should land on them.

There has thus been outlined, rather broadly, the more important features of the invention in order that the more detailed description thereof that follows may be better understood, and in order that the present contribution to the art may be better appreciated. There are additional features that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore that the claims be regarded as including such equivalent constructions insofar as they do not depart from the spirit and scope of the present invention.

It is therefore an object of the present invention to provide a new board game apparatus and method which has many of the advantages of the board games mentioned heretofore and many novel features that result in a new board game that is not anticipated, rendered obvious, suggested, or even implied by any of the prior art board games, either alone or in any combination thereof.

It is another object of the present invention to provide a new board game, which may be easily and efficiently manufactured and marketed.

It is a further object of the present invention to provide a new board game, which is of a durable and reliable construction.

Still yet another object of the present invention is to provide a new board game for automobile racing enthusiasts, and Nascar® Stock Car Racing fans in particular, challenging players to utilize real-life racing strategies while moving their playing piece from the start area to the finish area along a plurality of possible movement paths.

Still yet another object of the present invention is to provide a new board game that would provide an enjoyable game that could be participated in for friendly competition and entertainment for two to forty players.

Even still yet another object of the present invention is to provide a new board game that would provide a challenge for adult automobile racing enthusiasts while simultaneously providing for younger players a learning apparatus for the rules and strategies of automobile racing that is both fun and educational.

These together with other objects of the invention, along with the various features of novelty which characterize the invention, it's operating advantages and the specific objects attained by it's uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 shows examples of draw cards forming a part of the present invention.

In the various figures of the drawing, like reference characters designate like parts.

DESCRIPTION OF THE PREFERRED EMBODIMENT

Figure 1:
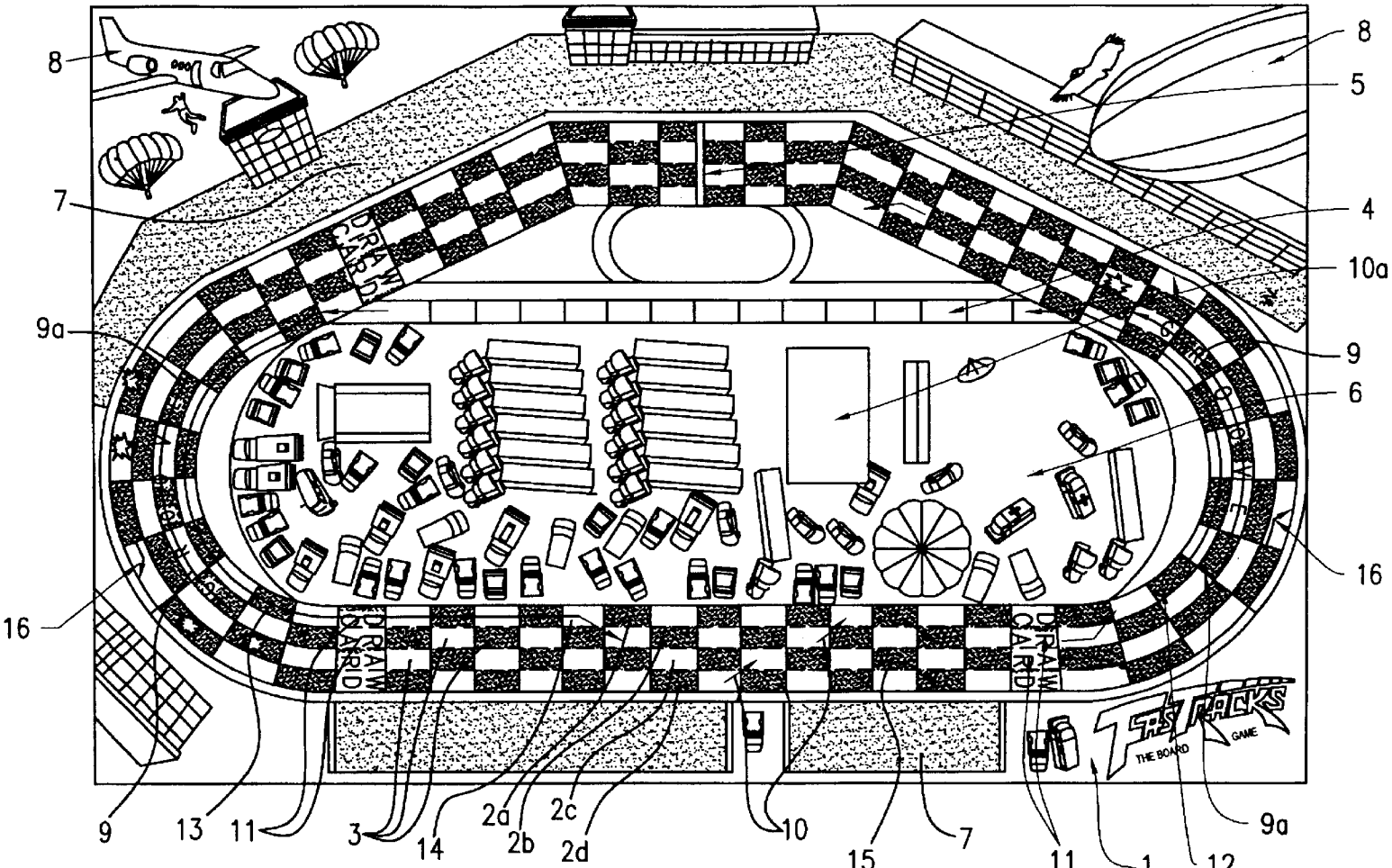
FIG. 1 is a top plan view of the game board forming a part of the present invention.
Figure 2:
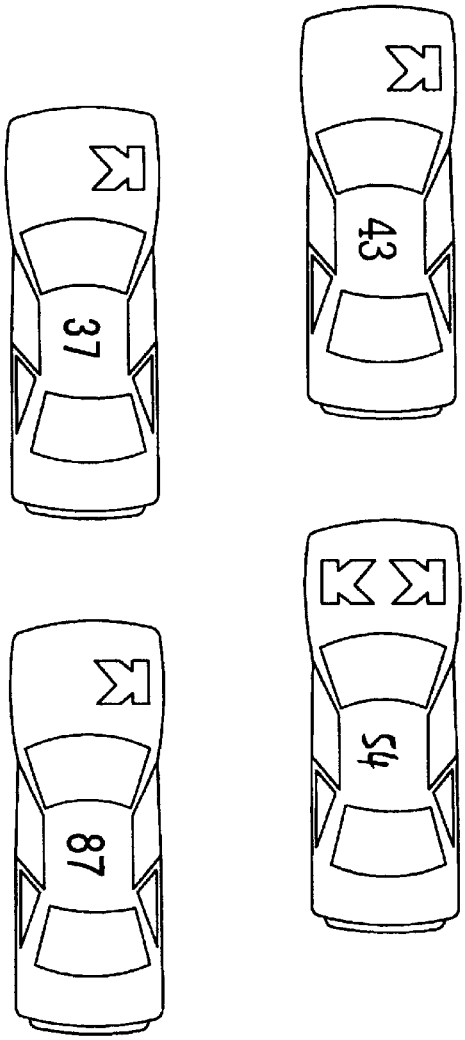
FIG. 2 shows a player's playing piece in the shape of a miniature racecar.
Figure 3:
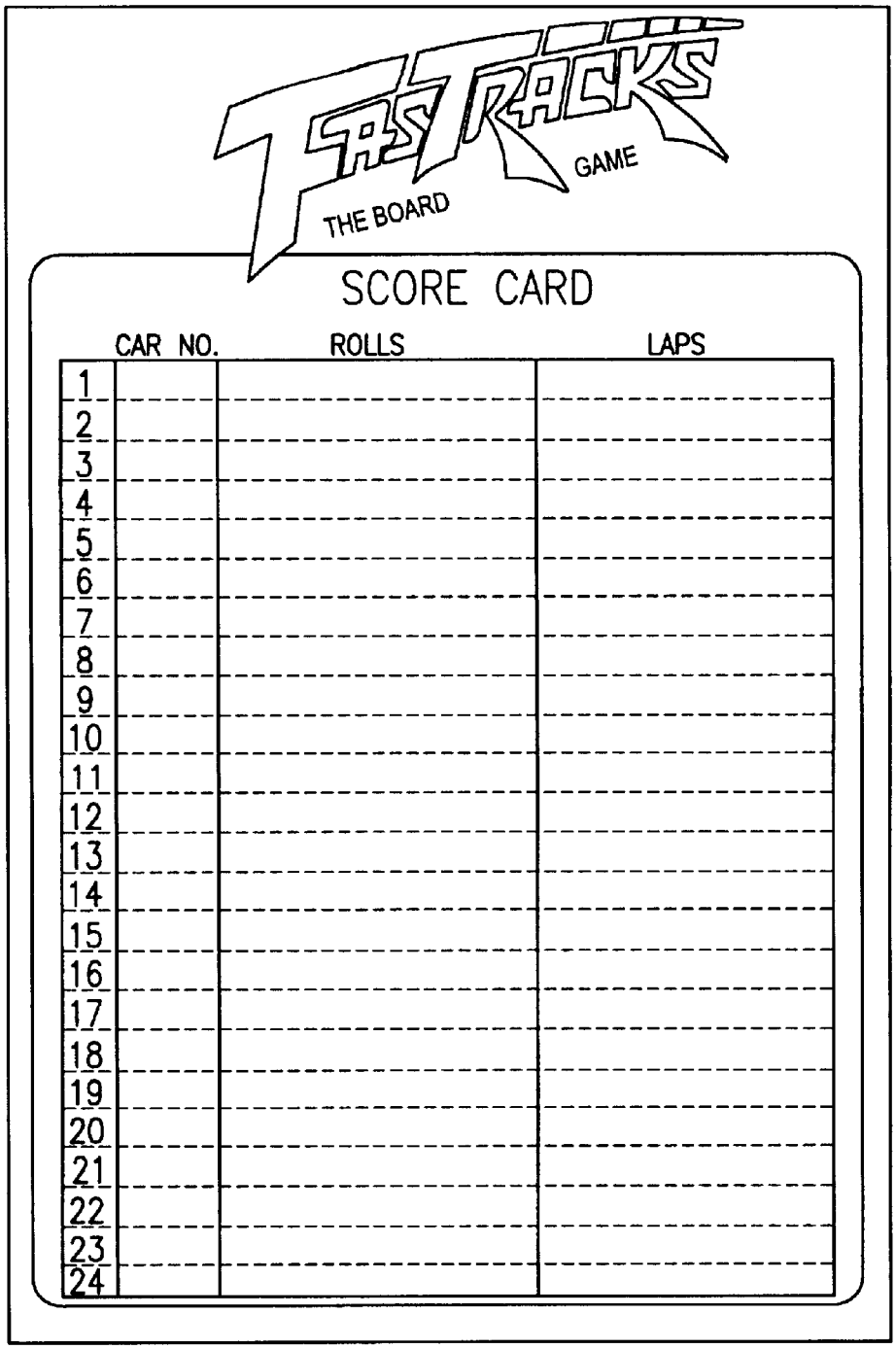
FIG. 3 is an example scorecard forming a part of the present invention.

With reference now to the drawings, and in particular to FIGS 1 through 3 thereof, a new board game embodying the principles and concepts of the present invention will be described.

Figure 1A:
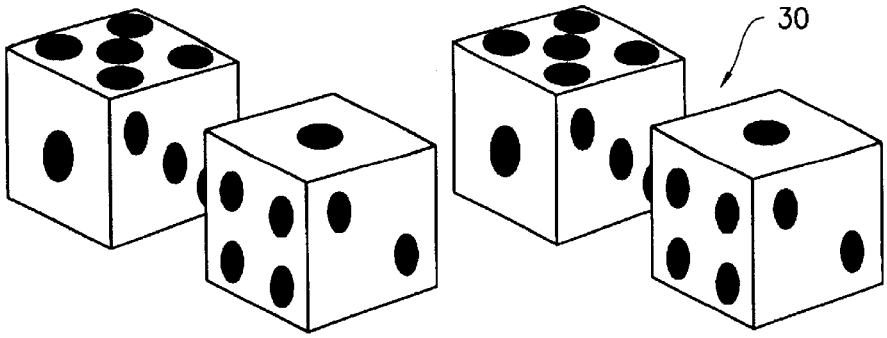
FIG. 1*a* shows a plurality of dice that may be used to generate numbers.

The preferred game set will consist of one game board (FIG. 1), a plurality of dice (means for generating numbers) (FIG. 1*a*), a plurality of playing pieces in the shape of miniature race cars (FIG. 2), a plurality of drawcards, and a scorecard (FIG. 3). Referring to FIG. 1, said game board 1 is substantially planer, generally rigid in structure, and generally rectangular in shape. Said game board 1 is a representation of a an automobile racing track (in this particular representation shown, the Charlotte Motor Speedway), The game board has a plurality of movement paths, or "lanes' disposed thereon. There are four lanes shown in the representative game board shown in FIG. 1, designated 2*a*, 2*b*, 2*c* and 2*d*. All of the said lanes are further divided into a plurality of individual spaces 3. Each player's game piece, representing a racecar, occupies exclusively one space (here designated as alternating black and white spaces) on the lanes. Said lanes comprise a roughly circular path around the racetrack, a pitlane 4 (described further below), and finally a start/finish line 5. Players' game pieces move in a counter-clockwise direction around the track to finish a predetermined number of "laps," or number of times they pass the start/finish line. The first player to cross the start/finish line after completing the predetermined number of laps is the winner, the second is awarded second place, and so on.

Additionally, the game board depicts additional elements typically found at a racetrack, such as an infield area 6 with representations of vehicles such a racing teams' transporters, helicopters, "tailgaters" vehicles; spectators seating 7 and even depictions of aircraft 8 such as blimps over the racetrack. These decorative elements serve to enhance the realistic feel of the board game, and also to give the game board a three-dimensional, from the air perspective. To initiate play, players will roll the dice 30 to determine their starting position on the "starting grid" lined up behind the start/finish line 5. The player with the highest roll gets the "pole position" (i.e., the first starting position closest to the start/finish line 5 and on the lane closest to the infield) and first pick of car. The game pieces, or cars (FIG. 2), are preferably miniature representations of actual racecars belonging to actual race teams and drivers. This enhances the players' immersion in the game as players get to role-play their favorite driver. Everyone rolls for starting position and pick of car. The cars will line up according to the following: two cars wide for 2–20 Cars, three cars wide for 21–30 Cars, and four cars wide for 31–43 Cars. When the cars are lined up 2 cars wide, they will line up on lanes 2*a* and 2*b*; three cars wide, lanes 2*a*, 2*b* and 2*c*, and so on. Note that each human player can play with more than one car/game piece, as long as the players keep track of which piece belongs to which player.

Once the starting grid is determined, the race begins. Each player, beginning with the pole sitter, takes turn rolling the dice. A player rolls the dice and his car advances the number of spaces according to the dice throw. Each space from the car position is counted, and a player must move the number of spaces according to the dice throw. If there is a car already occupying the ending space, the player must change lanes to avoid that other car or alternatively push that car forward in what is known as "drafting" (see below). Preferably, four dice is used for this purpose, for a minimum advance of four spaces and a maximum of twenty-four.

The "groove" (in automobile racing terms, a groove is the optimal and most stable line around a turn in the racetrack) is found between the turns in the racetrack and is depicted as 9 in FIG. 1. It counts as one space only and is the fastest way around the turns for a car. The groove can only be entered through the entrance end, depicted as 9*a*. If player misses the entrance end gets caught inside or outside the groove, he cannot jump into the groove and must continue on the top or bottom until he clears the groove. The player will lose track position because he has to travel six spaces instead of the single space of the groove. Additionally, he risks crashing his car because of the hazards located on the outside lane at the turns (described below).

A player's car can pass another car anywhere on the racetrack. Players must count every space forward and when changing lanes, side-to-side, except for the spaces with an arrow 10—they are counted as free spaces. These free spaces are advantageous when a player wants to change lanes or to overtake another player's car. Players cannot move back spaces unless he is instructed by a draw card (described below).

On occasions, a player may land on a space 11 labeled "Draw Card". The player must then draw one card from a deck of Draw Cards (FIG. 4) which is stacked on an area on the game board 10*a*. The Draw Cards would have instructions directing the player on how and where to move his game piece, including pitting in the pit lane 4. The draw cards add a further element of unpredictability to the race, much like in an actual race. When the player is instructed to pit, he must enter the pits by passing trough space 12, and proceeding through pit lane 4.

When players are in the pit lane, they roll with two dice only (as opposed to four dice on the race track) to signify a reduced speed, unless instructed otherwise by a draw card. Passing other cars in the pit lane is possible. If the player in front of the "pit driver" rolls a two (2) and the "pit driver" rolls an eight [8], the pit driver will pass him and count his space. When a car is clear of pit row and rejoins the race, it must stay at the bottom lane of the track 13 until he reaches the exit space 14 on the back stretch. Once the cars are clear of pit row, he must draft if needed. He cannot pass until he reaches back stretch exit.

Drafting refers to the way how cars can work together aerodynamically. By traveling lined up to each other nose-to-tail at high speeds, the car in front removes the air resistance of the car behind it, and a line of cars can actually travel faster than each car is capable of on its own. Drafting is accurately represented in this board game as a way players can work together. This is accomplished when a player rolls the dice and moves his spaces. If there is one or more cars lined up in front of the player, the player can change lanes and pass them, or he can push the whole line of cars forward. If he chooses to push the cars forward, all the players must stay in their lane. If a player changes lanes, he must leave the other cars in the draft. The other players cannot change lanes unless they draft through an arrow. Players can help themselves or another but be careful—Drivers can push other players out of the groove or cause a crash.

One of the ways to have a crash is a car must be sitting at the end of a Change lane arrow 15 (but not at the end of a straight arrow, such as the groove 9). Be careful if there is a car sitting at the end of a change lane arrow. A player must go around this car. If he goes through the same arrow, he will wreck his car and his opponent's car also.

When there is a crash, a "caution" comes out. During the caution period, cars hold their position (i.e., cars do not pass one another on the race track) and come to the start/finish line 5. The car that caused the "caution" and other cars that were also involved in the crash, goes to the pits and rolls out with two dice. The last car in the wreck rolls last. At the start/finish line, the car in the lead rolls first and then the second, and so on, and racing is resumed.

If, for example, it was a player's turn to roll after caution came out and he was in fifth place, rolling begins with the leader and player will roll fifth. Keep the laps count and reposition cars in the new "rolling" order.

There are red arrows spaces 16 up against the wall in turns 1-2-3-4. These represent how a race car can lose control when going into a turn too deep (and outside of the groove 9), and consequently can hit the wall. If a player drafts (i.e. pushes) a single car onto a red arrow space 16, stops him on the red arrow and the player changes lanes and leaves the other car, the other car hits the wall. The next player to roll will roll four dice. If the total is 12 or under, a caution comes out. If the dice are over 12, the race continues. If the race continues without a caution, the driver that hit the wall must pit. When he gets to the pit entrance, he rolls two dice only. If he lands on "draw card" on his way to the pits, it is void since he has to enter the pits regardless. Players should try to stay on the lead lap, that it, to not be lapped by the leader of the race. If the lead car goes around and crosses the finish line before the pit driver gets out of the pits, the pit driver will go a lap down.

A score card (FIG. 3) is provided to record the players' track positions and number of laps completed. This is especially important since a player may be lapped by the leader and go a lap down towards the total number of laps required.

As to a further discussion of the manner of usage and operation of the present invention, the same should be apparent from the above description.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, an(I accordingly, all suitable modifications and equivalents may be resorted to, falling within the scope of the invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A new and improved board game and rules associated therewith for automobile racing enthusiasts, comprising;

a plurality of playing pieces for movement along a plurality of movement paths on a game board, said game board representing an automobile race track, said movement, paths divided into a plurality of individual spaces over which player pieces may move, said spaces representing a spot a playing piece can occupy on said automobile race track;

means for generating numbers representing the number of spaces which said pieces may move;

a plurality of draw cards representing mandatory requirements to be satisfied by the players, and a plurality of spaces on the movement paths directing players to draw a card from said plurality of draw cards;

means, including said rules, for directing the movement of said playing pieces onto adjacent paths without using up numbers from said means for generating, when said playing pieces land on particular spaces with directional markings, said rules requiring using up of said numbers to move onto adjacent paths at all other times; and means for recording players' laps completed on said game board.

2. The new and improved board game as described in claim 1, wherein said movement paths on said game board include movement paths that are shorter compared to other movement paths.

3. The new and improved board game as described in claim 1, wherein said movement paths on said game board include a pit lane that requires players' pieces moving on it to advance slower compared to players' pieces advancing on a movement path other than the pit lane.

4. The new and improved board game and rules associated therewith as described in claim 1, further comprising means, including said rules, for linking the movement of two or more of said playing pieces in a line, thereby simulating drafting effects in automobile racing.

5. A new and improved board game and rules associated therewith for automobile racing enthusiasts, comprising;

a plurality of playing pieces for movement along a plurality of movement paths on a game board, said game board representing an automobile race track, said movement, paths divided into a plurality of individual spaces over which player pieces may move, said spaces representing a spot a playing piece can occupy on said automobile race track;

means for generating numbers representing the number of spaces which said pieces may move;

a plurality of draw cards representing mandatory requirements to be satisfied by the players, and a plurality of spaces on the movement paths directing players to draw a card from said plurality of draw cards;

directional markings on said game board that, together with said rules, visually direct the movement of said playing pieces onto adjacent paths without using up numbers from said means for generating numbers, when said playing pieces land on particular spaces with said directional markings, said rules requiring using up of said numbers to move onto adjacent paths at all other times; and means for recording players' laps completed on said game board.

* * * * *